US012601569B2

(12) United States Patent
Schroeder

(10) Patent No.: US 12,601,569 B2
(45) Date of Patent: Apr. 14, 2026

(54) SYSTEMS FOR PROJECTING HIGH VOLTAGE ELECTRICAL DISCHARGES IN AIR

(71) Applicant: Jonathan Schroeder, Calgary (CA)

(72) Inventor: Jonathan Schroeder, Calgary (CA)

( * ) Notice: Subject to any disclaimer, the term of this patent is extended or adjusted under 35 U.S.C. 154(b) by 157 days.

(21) Appl. No.: 18/608,995

(22) Filed: Mar. 19, 2024

(65) Prior Publication Data

US 2025/0297836 A1 Sep. 25, 2025

(51) Int. Cl.
*F41H 13/00* (2006.01)

(52) U.S. Cl.
CPC ..... *F41H 13/0025* (2013.01); *F41H 13/0062* (2013.01)

(58) Field of Classification Search
CPC . F41H 13/0062; F41H 13/0043; F41H 13/005
See application file for complete search history.

(56) References Cited

U.S. PATENT DOCUMENTS 3,719,929 A * 3/1973 Fay ..... G11C 29/56 714/719
4,453,196 A * 6/1984 Herr ..... H02J 50/30 361/232
5,293,527 A 3/1994 Sutton et al.
5,675,103 A * 10/1997 Herr ..... F41H 13/005 361/232
6,614,135 B1 9/2003 Clapham
7,034,739 B2 4/2006 Osepchuk
7,675,731 B2 3/2010 Bitar
8,004,816 B1 8/2011 Alder
8,274,776 B2 9/2012 Adler
8,476,901 B2 7/2013 Cornwell
8,772,974 B2 * 7/2014 Lane ..... H02J 50/80 307/151
9,603,234 B2 3/2017 Fuchs et al.
9,937,895 B2 4/2018 Stimson et al.
10,342,111 B2 7/2019 Nishikata et al.
(Continued)

FOREIGN PATENT DOCUMENTS

DE 102006031742 1/2008

OTHER PUBLICATIONS

ISR, PCT/IB2024/062494, May 9, 2025.
(Continued)

*Primary Examiner* — Reginald S Tillman, Jr.
(74) *Attorney, Agent, or Firm* — Lewellyn Law, PLLC; Stephen Lewellyn

(57) ABSTRACT

A system for projecting high voltage electrical discharges along laser filaments in air has a high voltage electrical discharge device operable to generate and discharge a high voltage electrical discharge. A laser assembly has at least one laser operable to produce laser electrically conductive laser filaments in air. An electrode is electrically connected to the high voltage electrical discharge device and configured to direct a high voltage electrical discharge at a breakout point of the electrode. The electrode breakout point is disposed in relation to the at least one laser such that when electrically conductive laser filaments are created in air by the at least one laser the high voltage electrical discharge at the breakout point is caused to travel along the electrically conductive laser filaments in air.

3 Claims, 3 Drawing Sheets

(56) References Cited

U.S. PATENT DOCUMENTS

| | | | |
|---|---|---|---|
| 10,801,817 | B2 | 10/2020 | Nishikata et al. |
| 11,209,247 | B2 | 12/2021 | Stark et al. |
| 11,605,929 | B2 | 3/2023 | Rockenfeller et al. |
| 11,747,116 | B2 | 9/2023 | Furlong et al. |
| 2006/0098378 | A1 | 5/2006 | Gross |
| 2008/0285200 | A1 | 11/2008 | Messer |
| 2012/0265048 | A1 | 10/2012 | Biggs et al. |
| 2012/0280610 | A1 | 11/2012 | Lundquist et al. |
| 2020/0217626 | A1 | 7/2020 | Haole |
| 2023/0066590 | A1 | 3/2023 | Kadetov |
| 2023/0243620 | A1 | 8/2023 | Hamer et al. |

OTHER PUBLICATIONS

Leonid, A et al., Large scale telsa coil guided discharges initiated by femtosecond laser lamentation in air. Journal of Applied Physics, American Institute of Physics (AIP), 2014, 116, pp. 13303. <10.1063/1.4886582> <hal-01118217>.

* cited by examiner

SYSTEMS FOR PROJECTING HIGH VOLTAGE ELECTRICAL DISCHARGES IN AIR

FIELD OF THE INVENTION

The invention relates to devices for forming and projecting electromagnetic pulses, and more specifically to systems for forming and projecting high voltage electric discharges along laser filaments in air.

BACKGROUND OF THE INVENTION

Military airborne threat environments must deal with long-range, mid-range and back-end drone swarm threats while defending high value and stationary assets. Current anti-drone and counter-unmanned aerial system (C-UAS) defenses use kinetic hard kill or directed energy High-Power Microwave (HPM) and communication jamming soft kill techniques to provide solutions to this problem. Kinetic hard kill refers to the use of munitions to physical attack the threat. Soft kill refers to the use of devices that operate to disrupt electronic systems of the threat.

In the C-UAS defense space there is a desire for a mid-range to back-end defeat solution that combines kinetic hard kill and directed energy electromagnetic pulse (EMP) soft kill solutions into one robust, scalable, highly mobile platform as part of a directed energy ecosystem that synergistically compliments HPM and does away with bulky and expensive ammunition and cumbersome communications jamming equipment.

High voltage electrical discharged devices are known. For example, a Tesla Coil is a well-known device capable of emitting a high voltage electrical spark. U.S. Pat. No. 7,675,731, the entirety of which is incorporated herein, discloses a tunable and aimable artificial lightening producing device that uses the electrical discharge of a tesla coil to provide an electrical spark in air. U.S. Pat. No. 8,004,816, the entirety of which is incorporated herein, describes a device using a Tesla coil for generating an electric field in the vicinity of an electric target. U.S. Pat. No. 6,614,135, the entirety of which is incorporated herein, describes a device for generating an electromagnetic pulse for disrupting electrical circuits.

SUMMARY OF THE INVENTION

In aspects this disclosure relates to systems for projecting electromagnetic discharges along laser filaments in air. In aspects, the systems disclosed herein may be used in anti-drone and counter-unmanned aerial system (C-UAS) defenses for soft kills of aerial threats.

In aspects a system for projecting electromagnetic discharges along laser filaments in air may have a high voltage electric discharged device, such as a Tesla Coil, and a laser configured to produce plasma filaments in air. In aspects, the electric discharge device and laser are arranged and configured such that high voltage electric discharges from the electric discharged device are projected linearly along plasma filaments produced by the laser.

In an aspect, a system for projecting high voltage electrical discharges along laser filaments in air has a high voltage electrical discharge device operable to generate and discharge a high voltage electrical discharge; a laser assembly having at least one laser operable to produce laser electrically conductive laser filaments in air; an electrode electrically connected to the high voltage electrical discharge device and configured to direct a high voltage electrical discharge at a breakout point of the electrode; and wherein the electrode breakout point is disposed in relation to the at least one laser such that when electrically conductive laser filaments are created in air by the at least one laser the high voltage electrical discharge at the breakout point is caused to travel along the electrically conductive laser filaments in air.

In an aspect, the release of the high voltage electrical discharge at the breakout point and the firing of the at least one laser to form the conductive filaments can be timed to occur simultaneously.

In an aspect, the high voltage electrical discharge device may be a Tesla coil and the electrode is electrically connected to a torus of the Tesla coil.

In an aspect, the electrode may be an insulated wire having one end electrically connected to the high voltage electrical discharge device and an opposite end stripped of insulation exposing a bare wire end and wherein the bare wire end is the breakout point.

In an aspect, the electrode may be a firing cone having an opening along its center and constructed of an electrically conductive material, and wherein one end of the firing cone is electrically connected to the high voltage electrical discharge device and an opposite end of the firing cone provides the breakout point. In an aspect, the at least one laser may be disposed in the torus of the Tesla coil and aligned to fire the laser through the open center of the firing cone.

In an aspect, the at least one laser may have two or more lasers with their discharge ends facing in the same direction and wherein the breakout point of the electrode is disposed such that it is located between electrically conductive laser filaments when produced by the two or more lasers.

In an aspect, the laser assembly may be movably mounted to a support for rotation about a vertical axis and for rotation about a horizontal axis.

In an aspect, a laser of the at least one laser may be a femtosecond laser. In an aspect, a laser of the at least one laser may be a picosecond laser.

In an aspect, the laser filaments produce electromagnetic pulse (EMP) effects capable of disrupting electronic equipment.

In an aspect, the high voltage electrical discharges produce EMP effects disruptive to electronic equipment.

In an aspect, The combined EMP effects from both the laser filaments, and the moving high voltage charge conducted to the target along the laser filaments provide soft kill defeat capabilities of electronic equipment in drones and manned and unmanned aerial systems and ground targets.

In an aspect, the disclosure relates to a directed energy device to provide air and ground counter-unmanned aerial system defense capabilities comprising elements of a laser or similar device producing air filament-generated plasmas mounted within the hollow torus of a Tesla coil or similar electro-magnetic field generator producing scalable, high voltage electrical discharges. The laser or similar device produces air filament-generated plasmas along the path of the laser beam by a phenomenon known as the Kerr effect. The high energy electrical discharges of the electro-magnetic field generator are made to follow the electrically conductive air filament-generated plasmas through the air along the substantially straight laser beam path to targets at high velocities and rapid firing rates providing kinetic hard kill defeat of targets. The single or multiple air filament-generated plasmas also produce associated primary electromagnetic pulse (EMP) effects, and the high voltage electrical discharges from the electro-magnetic field generator that are electrically conducted along the path of the air filament-generated plasmas also produce secondary EMP effects providing soft kill defeat of targets.

Numerous additional objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be made to the accompanying drawings and descriptive matter in which there are illustrated embodiments of the invention.

BRIEF DESCRIPTION OF THE DRAWINGS

The following drawings illustrate by way of example and are included to provide a further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature or a feature with similar functionality. In the drawings.

DETAILED DESCRIPTION

The following detailed description of embodiments of the invention references the accompanying drawings. The embodiments are intended to describe aspects of the invention in sufficient detail to enable those skilled in the art to practice the invention. Other embodiments can be utilized, and changes can be made without departing from the scope of the disclosure.

Figure 1:
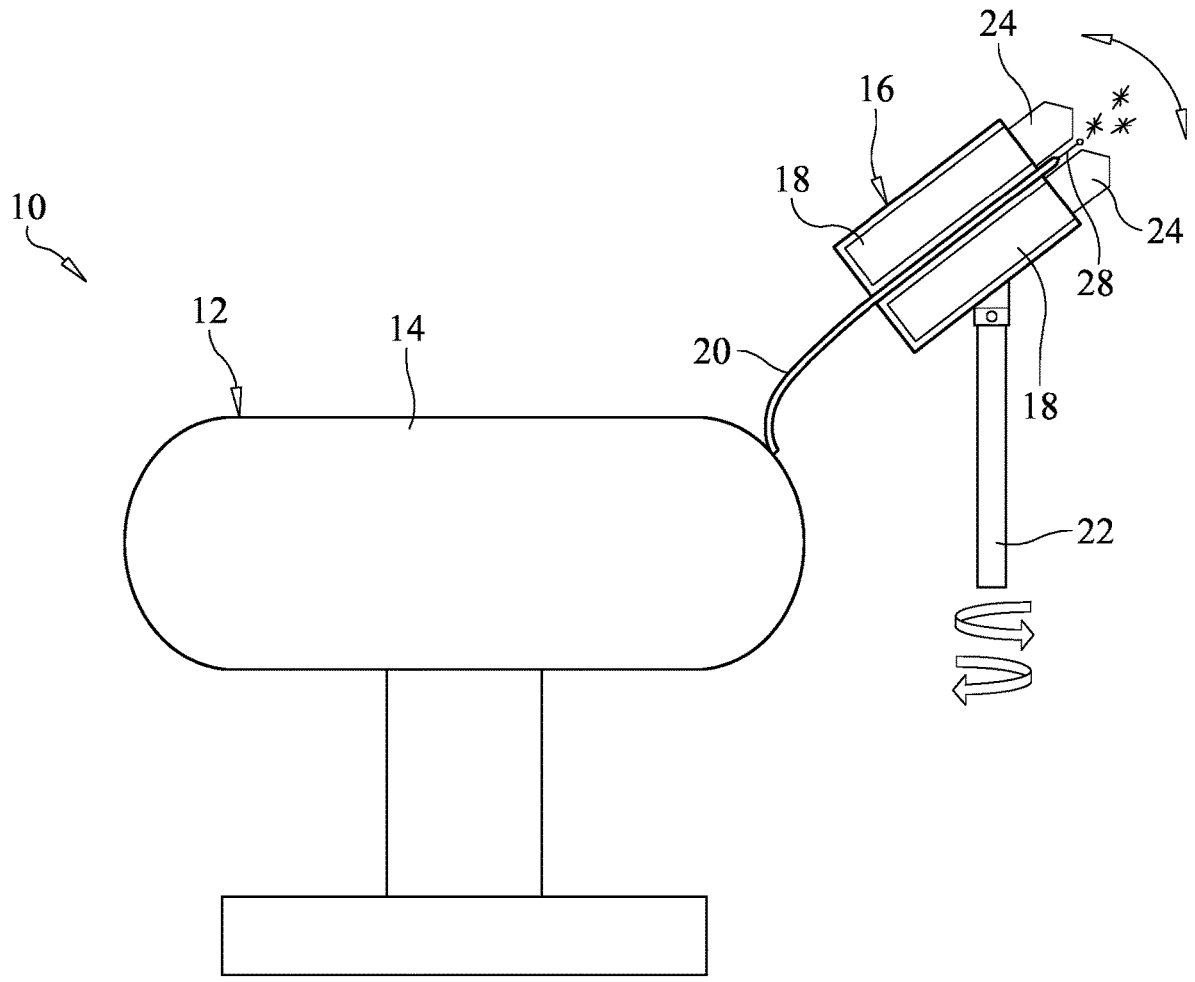
FIG. 1 is a diagrammatic illustration of a system for projecting high voltage electrical discharges along laser filaments in air in accordance with at least one embodiment of the invention.

In FIG. 1, there is diagrammatically illustrated system 10 for projecting high voltage electrical discharges along laser filaments in air in accordance with at least one embodiment of the invention. System 10 has a high voltage electrical discharge device 12, such as a Tesla coil, having an electrode representatively illustrated as the torus or toroid 14 of the Tesla coil. A Tesla coil is a well-known resonant transformer that typically uses an alternating current power source and at least two coils to generate a high voltage at an electrode. Such devices are well known in the art, accordingly a detailed description of their construction and operation is not necessary here.

System 10 further includes a laser assembly 16. Assembly 16 has at least one laser, representatively shown here has having two lasers 18, but additional lasers could be used. The lasers 18 are arranged with their emitting ends facing in the same general outwardly direction. Lasers 18 can produce laser filaments 24 in air based on the well-known Kerr effect phenomenon. Lasers 18 may be femtosecond or picosecond lasers capable of producing intense ultrashort laser pulses through the atmosphere, thereby creating a long thin column of ionized plasma (filamentation) that is electrically conductive.

System 10 further includes an electrode, representatively shown here as an insulated wire 20 having one end electrically connected to torus 14 of the Tesla coil. The opposite end of wire 20 has a length of insulation removed exposing the bare inner wire which is disposed in front of the emitting ends of lasers 18. The bare end of wire 20 provides a breakout point 28 for a high voltage electrical discharge 26 created by the Tesla coil. In aspects, the bare end of wire 20 is disposed colinear with the filaments produced by one or more lasers 18. In aspects, Lasers 18 can surround the wire breakout point, and the laser filaments can be oriented and directed to travel through a wider opening at the end of assembly 16 with wire 20 conducting the electrical discharge located in the center of the laser filaments. This configuration places the high voltage discharge within the center of the laser filaments produced by lasers 18. In any configuration, the breakout point (the bare end) of wire 20 is disposed near the laser filaments produced by lasers 18 such that the electrical discharge from the Tesla coil is caused to travel along the electrically conductive filaments in the air. Essentially, the direction of the filaments in the air that are produced by the lasers 18 guides the electric discharge(s) through the air. In embodiments, the release of the high voltage electrical discharge at the breakout point and the firing of the at least one laser to form the conductive filaments can be timed to occur simultaneously.

When lasers 18 discharge powerful self-focusing laser pulses at a mission specific prescribed frequency and pulse length into the local medium, in this case air, the femtosecond laser pulse will produce a self-focusing plasma filament 24 via a phenomenon known as the Optical/AC Kerr effect. Due to the Kerr effect causing the self-focusing or self-guiding of the plasma filament in air, laser pulses may be initially adjusted with an optical compressor and a beam expander to optimize filament stability at longer distances.

In aspects, assembly 16 may be movably mounted for aiming the direction of the filaments and thus the high voltage electrical discharged traveling along the filaments. In the representatively illustrated embodiment, assembly 16 can be supported on a rotatable mast 22 for rotation about the vertical. Further assembly 16 can be pivotally supported on mast 22 for elevational positioning of the discharge ends of the lasers 18. While not shown, known motive devices could be employed to provide the desired movement of assembly 16 in space.

Figure 2:
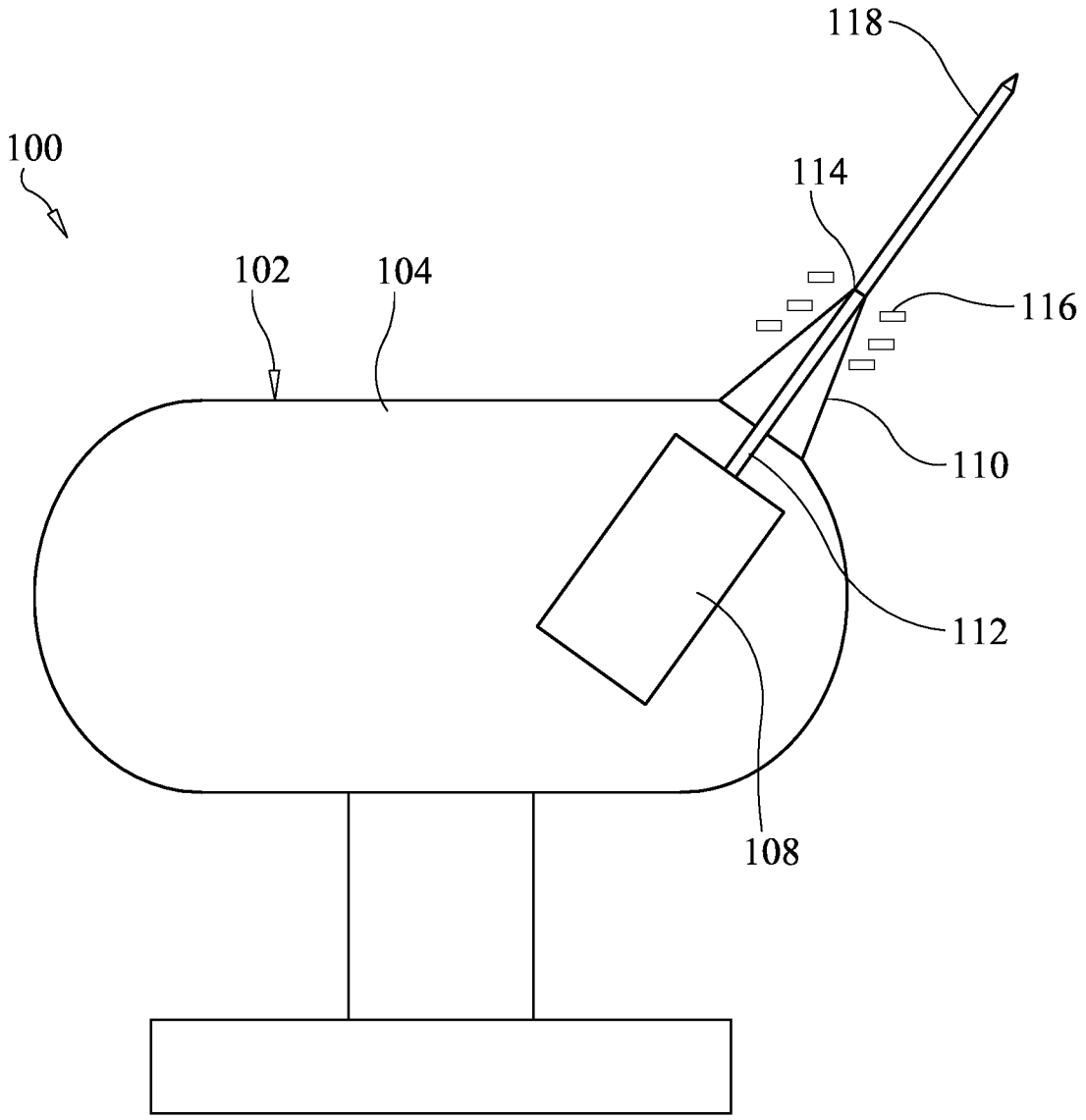
FIG. 2 is a diagrammatic illustration of a system for projecting high voltage electrical discharges along laser filaments in air in accordance with at least one other embodiment of the invention.

In FIG. 2 there is diagrammatically illustrated system 100 for projecting high voltage electrical discharges along laser filaments in air in accordance with at least one other embodiment of the invention. Like system 10 discussed above, system 100 shown here has a high voltage electrical discharge device 102, such as a Tesla coil, having an electrode representatively illustrated as the torus or toroid 104 of the Tesla coil. Like torus 102, torus 104 may be hollow and electrically conductive and located at the top of the Tesla coil tower 106. The torus 104 may be rotatable through 360 degrees on the axis of the Tesla coil tower.

System 100 further includes laser 108 that may be located within the hollow Tesla coil torus 104. Like laser(s) 18 discussed above, laser 108 can produce laser filaments in air based on the well-known Kerr effect phenomenon. Laser 208 is arranged with its emitting end facing in an outward direction from the torus 104. System 100 further includes a firing cone 110. cone 110 is open along it center from end to end and is constructed of a conductive materials that it is electrically conductive. Firing cone 110 is in electrical contact with the Tesla coil torus 104.

Laser 108 and the hollow firing cone 110 are fixed together such that the path of laser pulses 112 are always directed out the breakout point 114 at the open apex of the hollow firing cone allowing the laser, the pulses, the breakout point at the open apex of the hollow firing cone and a selected target to be aligned on a straight-line path colinear with one another. Laser 208 and firing cone 110 can be movably mounted for conjoined movement to elevate and depress more than 90 degrees from sub-horizontal to vertical.

Figure 3:
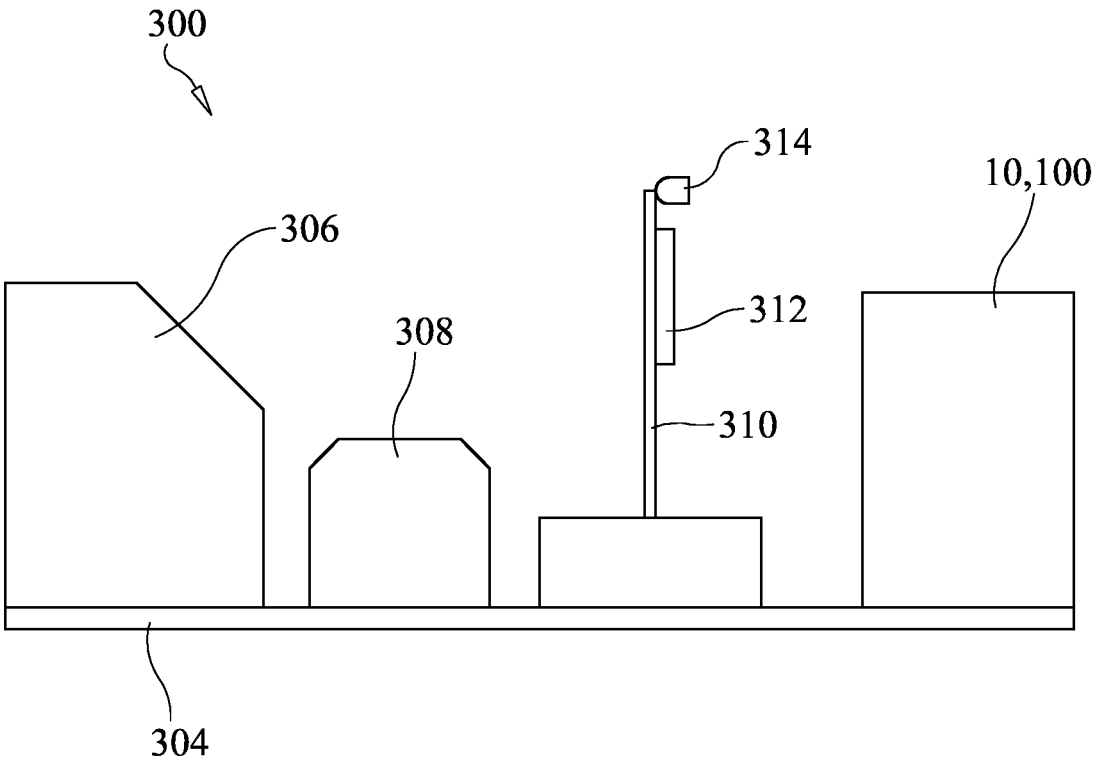
FIG. 3 is a diagrammatic illustration of a short rang air defense system in accordance with a least one embodiment of the invention.

Further illustrated are high voltage electrical discharges 116 spark from the Tesla coil torus 104 via the breakout point 114 at the open apex of the hollow firing cone 110, with the path of the self-focusing femtosecond laser producing single or multi air filament-generated plasmas 118 generated by the laser 108. When torus 104 is operating at the maximum discharge power based on the scalable design selected for the mission type of the present invention, a high voltage charge 116 will build up on the Tesla coil torus 104 and will transfer to the hollow firing cone 110 and concentrate at the breakout point 114 at the open apex of the hollow firing cone producing electrical coronal discharges as the high voltage electric field exceeds the dielectric capacity of the air. When laser 108 discharges a powerful self-focusing laser pulse or pulses 118 at a mission specific prescribed frequency and pulse length into the local medium, in this case air, the femtosecond laser pulse 118 will produce a self-focusing plasma filament 120 via a phenomenon known as the Optical/AC Kerr effect. Due to the Kerr effect causing the self-focusing or self-guiding of the plasma filament in air, laser pulses 118 may be initially adjusted with an optical compressor and a beam expander to optimize filament stability at longer distances. In embodiments, the release of the high voltage electrical discharge at the breakout point and the firing of the at least one laser to form the conductive filaments can be timed to occur simultaneously In FIG. 3, there is diagrammatically illustrated a short rang air defense system 300 in accordance with a least one embodiment of the invention. System 300 is a directed energy device and may have a mounting platform 304 similar to a NATO-Standard Demountable Rack Offload and Pickup System platform which can be carried on any compatible vehicle, a control station 306 allowing either onboard or remote control of the air defense system, onboard electric generators 308 providing autonomy of the system from local power supplies, one or more of systems 10, 100 described above, a retractable radar and optical targeting system mast 310, electronically scanned array radars 312 providing 360 degree coverage, and an optical targeting system 314.

The internal components, software, and protocol structures of control station 306, generator system 308, retractable mast 310, electronically scanned array radars 312, and optical tracking systems 314 of the present invention will not be described in detail since such technology is generally well known.

The many features and advantages of the disclosure are apparent from the detailed specification, and thus, it is intended by the appended claims to cover all such features and advantages of the invention which fall within the true spirit and scope of the disclosure. Further, since numerous modifications and variations will readily occur to those skilled in the art, it is not desired to limit the invention to the exact construction and operation illustrated and described, and accordingly, all suitable modifications and equivalents may be resorted to, falling within the scope of the disclosure.

What is claimed is:

1. A system for projecting high-voltage electrical discharge through air, comprising:

a high-voltage electrical discharge device comprising a tesla coil having a hollow torus electrode;

a firing cone constructed of electrically conductive material, the firing cone having a passage extending between opposite ends thereof, the firing cone is electrically connected to the hollow torus electrode and tapers from a wide end to a narrow end in a direction away from the hollow torus, the narrow end providing a breakout point for an electrical discharge from the hollow torus electrode, a laser assembly having at least one laser operable to produce electrically conductive laser-induced plasma filaments in air;

wherein the at least one laser is disposed in the hollow torus electrode and arranged with a discharge end of the at least one laser aligned with the passage of the firing cone so that electrically conductive laser-induced plasma filaments produced by the at least one laser pass through the passage of the firing cone; and wherein when electrically conductive laser-induced plasma filaments pass through the passage of the firing cone, an electrical discharge at the breakout point is caused to travel along the electrically conductive laser-induced plasma filaments in air.

2. The system of claim 1, wherein a laser of the at least one laser is a femtosecond laser.

3. The system of claim 1, wherein a laser of the at least one laser is a picosecond laser.

* * * * *